United States Patent [19]

Perrone

[11] Patent Number: 5,076,462

[45] Date of Patent: Dec. 31, 1991

[54] MULTIPLE PARTITIONED SORTING PAIL

[76] Inventor: William J. Perrone, 48 Cypress Loop, Staten Island, N.Y. 10309

[21] Appl. No.: 620,343

[22] Filed: Nov. 29, 1990

[51] Int. Cl.[5] ..... B65D 90/00

[52] U.S. Cl. ..... 220/404; 220/532; 220/909

[58] Field of Search ..... 220/909, 908, 404, 528, 220/532

[56] References Cited

U.S. PATENT DOCUMENTS

| | | | |
|---|---|---|---|
| 4,593,615 | 6/1986 | Kehl | 220/908 X |
| 4,729,489 | 3/1988 | Dapaianni | 220/404 X |
| 4,834,262 | 5/1989 | Reed | 220/404 |
| 4,867,328 | 9/1989 | McCarthy | 220/404 X |
| 4,913,308 | 4/1990 | Culbertson | 220/908 X |
| 4,955,495 | 9/1990 | Ruebesam | 220/908 X |

*Primary Examiner*—Steven M. Pollard

*Attorney, Agent, or Firm*—Richard L. Miller

[57] ABSTRACT

A multiple partitioned sorting pail is proved and consists of a base member having an open top, a plurality of compartments therein and transverse slots therebetween to properly retain plastic bags that are inserted within the compartments to hold recyclable and non-recyclable garbage.

3 Claims, 1 Drawing Sheet

Fig. 2
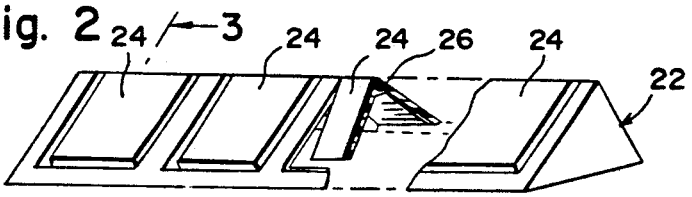
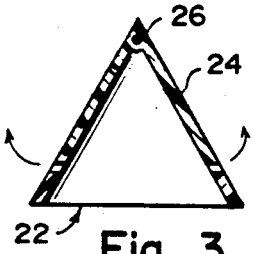
Fig. 3
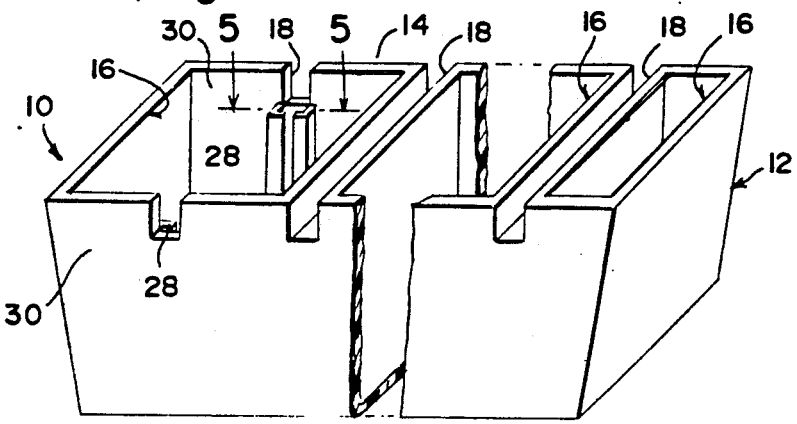
Fig. 1
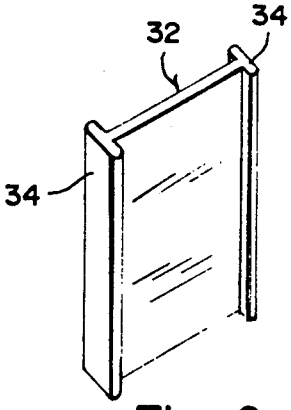
Fig. 6
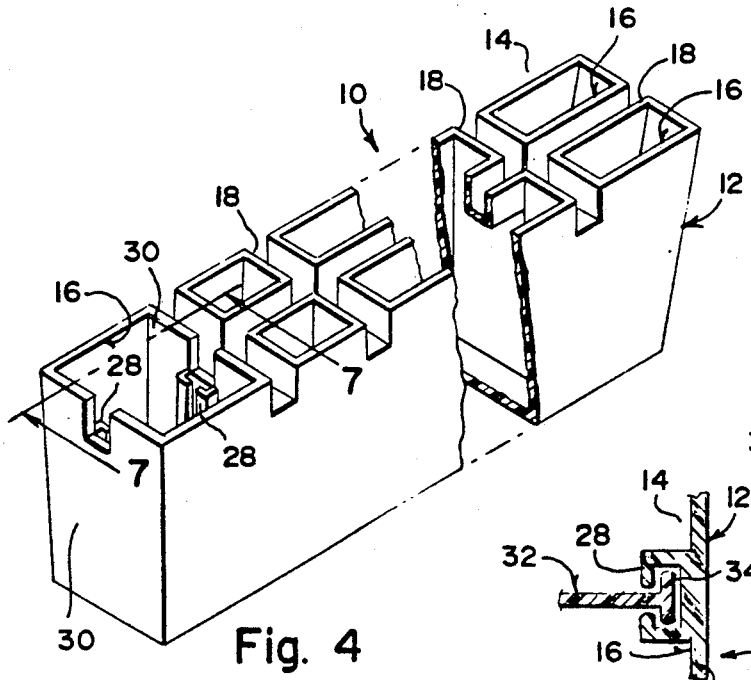
Fig. 4
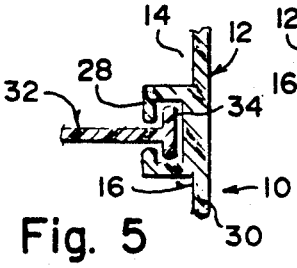
Fig. 5
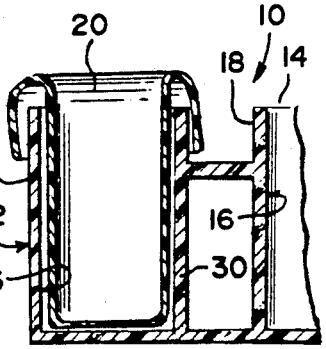
Fig. 7

MULTIPLE PARTITIONED SORTING PAIL

BACKGROUND OF THE INVENTION

The instant invention relates generally to trash baskets and more specifically it relates to a multiple partitioned sorting pail.

Numerous trash baskets have been provided in the prior art that are adapted to hold various types of garbage therein. While these units may be suitable for the particular purpose to which they address, they would not be as suitable for the purpose of the present invention as hereafter described.

SUMMARY OF THE INVENTION

A primary object of the present invention is to provide a multiple partitioned sorting pail that will overcome the shortcomings of the prior art devices.

Another object is to provide a multiple partitioned sorting pail that includes a base member having a plurality of compartments with transverse slots therebetween to properly hold plastic bags for recyclable and non-recyclable garbage.

An additional object is to provide a multiple partitioned sorting pail that includes some of the compartments having removable partitions so as to divide the compartments in half to hold extra plastic bags for additional garbage to be stored therein.

A further object is to provide a multiple partitioned sorting pail that is simple and easy to use.

A still further object is to provide a multiple partitioned sorting pail that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view illustrating the base member of a first embodiment of the instant invention.

FIG. 2 is a cover therefore;

FIG. 3 is a cross sectional view taken on Line 3—3 on FIG. 2;

FIG. 4 is a diagrammatic perspective view similar to FIG. 1 illustrating a base member of a second embodiment of the instant invention.

FIG. 5 is a cross sectional view with parts broken away taken on line 5—5 of FIG. 1, with a partition installed therein.

FIG. 6 is a perspective view of a typical removable partition for use in either embodiment; and FIG. 7 is a cross sectional view taken in line 7—7 of FIG. 4, with a plastic bag installed therein.

DETAILED DESCRIPTION OF THE PREFERRED EMBODIMENTS

Turning now descriptively to the drawings, in which like reference characters denote like elements throughout the several views, FIGS. 1, 4, 5 and 7 illustrate a multiple partitioned sorting pail 10 consisting of a base member 12 having an open top 14, a plurality of compartments 16 therein and transverse slots 18 therebetween to properly retain plastic bags 20 that are inserted within the compartments 16 to hold recyclable and non-recyclable garbage.

As shown in FIGS. 2 and 3, a cover 22 can be provided. The cover 22 is in an inverted V-shaped configuration and has a plurality of flap doors 24 hinged at 26 thereon. The cover 22 fits onto the base member 12 so that each flap door 24 is located above one of the compartments 16 and the base member 12. The flap door 24 moves back and forth over the compartment 16 for easy access to the compartment 16.

At least one compartment 16 includes a pair of C-shaped track members 28 that are formed vertically on opposite walls 30 of the compartment 16. A removable partition 32, as shown in FIGS. 5 and 6, has a T-shaped configuration 34 along each end thereof so that the T-shaped configurations 34 will fit into the track members 28 so as to divide the compartment 16 in half to hold an extra plastic bag for additional garbage to stored therein.

The compartments 16 in the base member 12 can be divided in a side to side relationship with each other as best seen in FIG. 1. The compartments 16 in the base member 12 can also be divided in a back to back relationship with each other as best seen in FIG. 4. The base member 12 and the cover 11 can be fabricated out of a durable plastic material as shown. Other types of materials can be used. such as metal, wood or the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multiple partitioned sorting pail comprising a one-piece base member, having side walls of plastic material having an open top, a plurality of compartments therein and transverse slots therebetween to properly retain plastic bags that are inserted within the compartments to hold recyclable and non-recyclable garbage, at least one compartment in said base member including:

a) a pair of C-shaped track members, each formed vertically on an opposite side wall of said at least one compartment;

b) a removable partition having a T-shaped configuration along each end thereof so that each T-shaped configuration will fit into each said track member so as to divide the at least one compartment in half to hold an extra plastic bag for separated additional garbage to be stored therein;

c) a cover having a plurality of hinged flap doors thereon, said cover fitting onto said base member so that each said flap door is located above one of the compartments of said base member so as to move back and forth over the compartment for easy access to the compartment and d) open topped vertically extending slots formed in said side walls having said C-shaped track members, said slots in alignment with said C-shaped track members and terminating adjacent the top end of said C-shaped track members, said slots aiding in retaining plastic bags inserted within the compartments formed by the insertion of said removable partition.

2. A multiple partitioned sorting pail as recited in claim 1, wherein at least two of the compartments in said base members are in a side to side relationship with each other.

3. A multiple partitioned sorting pail as recited in claim 1, wherein at least two of the compartments is said base member are in a back to back relationship with each other.

* * * * *